US006230336B1

(12) United States Patent
Knoll et al.

(10) Patent No.: US 6,230,336 B1
(45) Date of Patent: May 15, 2001

(54) AUTOMATED TOILET SEAT AND SEAT COVER LIFTING AND LOWERING SYSTEM

(76) Inventors: David M. Knoll, 14844 Elijo Way, Jamul, CA (US) 91935; Donald H. Koenig, 1060 Oliver Ave., San Diego, CA (US) 92109

( * ) Notice: Subject to any disclaimer, the term of this patent is extended or adjusted under 35 U.S.C. 154(b) by 0 days.

(21) Appl. No.: 09/135,853

(22) Filed: Aug. 18, 1998

(51) Int. Cl.[7] ..... A47K 13/10

(52) U.S. Cl. ..... 4/246.2

(58) Field of Search ..... 4/246.1, 246.2

(56) References Cited

U.S. PATENT DOCUMENTS 1,821,027 * 9/1931 Oya ..... 4/246.2

FOREIGN PATENT DOCUMENTS

9006715 * 6/1990 (WO) ..... 4/246.2

* cited by examiner

*Primary Examiner*—Robert M. Fetsuga
(74) *Attorney, Agent, or Firm*—Charles C. Logan, II

(57) ABSTRACT

An automated toilet seat and seat cover lifting and lowering system that eliminates the need for the user to touch any area of the toilet with their hands. The system utilizes the force of pressurized water to lift the toilet seat and seat cover. A lever actuator housing is mounted on the top surface of the toilet bowl adjacent the rear end of the toilet seat. A plurality of lifting levers extend from the front end of the lever actuator housing and they are connected respectively to either the toilet seat or the seat cover. The actuator assembly inside the lever actuator housing has means for using pressurized water to raise the respective lifting levers and the toilet seat and seat cover attached to them from a horizontal position to a vertical position. Remote control buttons located on a wall separated from the toilet can be utilized to lift and lower the toilet seat or seat cover as desired.

7 Claims, 10 Drawing Sheets

AUTOMATED TOILET SEAT AND SEAT COVER LIFTING AND LOWERING SYSTEM

BACKGROUND OF THE INVENTION

The present invention relates to toilets and more particularly to a novel toilet seat and seat cover lifting and lowering system that eliminates the need for the user to touch either the seat or cover with their hands.

Many prior art toilet seat lifting devices are known, which permits the user to raise the toilet seat by stepping upon a pedal. By the use of levers, rods, cables or fluid displacing systems, the force of the user's foot is transmitted to the toilet seat so that the seat may be lifted without soiling the hands and without the inconvenience of bending down to reach the seat.

Although some such prior art devices are functional, they have not achieved wide acceptance and use in the United States. This lack of acceptance is believed to be due, at least in part, to several disadvantages inherent in the design in the prior art devices. Some devices, such as that disclosed in the Kemp U.S. Pat. No. 3,055,016 are mechanically complex and could therefore be prohibitively expensive to manufacture. Simpler and perhaps less costly devices, such as that disclosed in the Svedelius U.S. Pat. No. 1,999,070 have failed to provide any form of adjustment to fit toilets at varying heights. Some prior art devices must also be rigidly attached to the toilet and/or to the floor nearby to permit proper functioning. A practice of rigid permanent attachment has made cleaning of the toilet unnecessarily awkward, since the device may not be easily removed for regular cleaning.

It is an object of the invention to provide a novel toilet seat and seat cover lifting and lowering assembly that can be operated by a remote control.

It is also an object of the invention to provide a novel toilet seat and seat cover lifting and lowering system that eliminates the need for the user to touch either the seat or seat cover.

It is another object of the invention to provide a novel toilet seat and seat cover lifting and lowering system that diverts a portion of the pressurized water traveling to the water tank of the toilet and utilizes this pressurized water to operate actuator assembly means connected to lifting levers secured to the respective toilet seat and seat cover for raising them from a horizontal position to a vertical position.

It is another object of the invention to provide a novel toilet seat and seat cover lifting and lowering system that can utilize an infra-red sensing light to flush the toilet after the user has moved away from the toilet.

It is an additional object of the invention to provide a novel toilet seat and seat cover lifting and lowering system that can be retrofit to a majority of the existing toilets.

It is also an object of the invention to provide a novel toilet seat and seat cover lifting and lowering system that can be applied to new toilet designs such as being built in to the tank and out of sight.

It is another object of the invention to provide a novel toilet seat and seat cover lifting and lowering system having a modular lever actuating housing that is mounted on the top surface of the toilet bowl adjacent the rear end of the toilet seat.

It is a further object of the invention to provide a novel toilet seat and seat cover lifting and lowering system that keeps the seat cover closed on the toilet bowl and thereby keeping children and pets from getting into the toilet water.

SUMMARY OF THE INVENTION

The novel automated toilet seat and seat cover lifting and lowering system has been designed to eliminate the need for the person using the toilet to touch either the seat or seat cover with their hands. The operation of lifting and lowering the toilet seat and/or the seat cover is accomplished by pushing a button on a 12v self contained remote control transmitter (similar to a garage door opener) that would be mounted on a wall by the toilet or near the bathroom door entrance or alternate location. The preferred embodiment would have two buttons on the remote control housing. When button #1 is pressed, the toilet seat cover would be lifted from the horizontal position to the vertical position or returned from the vertical position to its original horizontal position. When button #2 is pressed, the toilet seat and seat cover would be lifted from a horizontal position to a vertical position and during its travels also lift the toilet seat cover. By pressing the #2 button a second time, the toilet seat would be returned to its original position or close via an infrared sensor.

The automated toilet seat and seat cover lifting and lowering system utilizes pressurized water to actuate the mechanical structure that lifts and lowers respectively the toilet seat and/or seat cover. All toilets have a primary tubular member whose one end is connected to a source of pressurized water and whose other end is connected to the bottom of the toilet tank. A T-connector is connected to the primary tubular member intermediate its length and a secondary tubular member connected thereto then provides pressurized water to the lever actuator housing. The lever actuator housing is mounted on the top surface of the toilet bowl adjacent the rear end of the toilet seat.

The lever actuator housing has four lifting levers extending forwardly from its front end. Two of these lifting levers are connected to the rear end of the seat cover and two of the lifting levers would be connected to the rear end of the toilet seat. The rear end of each of the lifting levers is connected to a horizontally oriented hinge disk having a transversely extending bore hole. The two outer hinge disks are mounted on the same horizontally extending splined primary shaft that mates with the shape of the bore holes in the outer hinge disks so that they rotate as a unit. The primary shaft is journaled in a splined secondary shaft that is shorter than the primary shaft. The two inner hinge disks are mounted on opposite ends of the splined secondary shaft that mates with the shape of the bore holes in the inner hinge disks so that they rotate as a unit. Rotation of the respective hinge disks lift the respective lifting levers from a horizontal position to a vertical position.

Inside lever actuator housing is a pair of laterally spaced vertically oriented piston cylinders each having a top end and a bottom end. A piston is mounted in each of these piston cylinders. The bottom ends of the piston cylinders are connected to an elongated bendable pressure band whose bottom surface is connected to a peripheral shoulder on specific vertically oriented hinge disks. Therefore, downward travel of the pressure band causes the hinge disks to rotate approximately through 90 degrees, thereby lifting the toilet seat and/or seat cover from a horizontal position to a vertical position.

The top ends of the piston cylinders are each connected to an electrically operated water inlet valve and an electrically operated water outlet valve. The water inlet valves are connected to the pressurized water by the secondary tubular member. The water outlet valves would be connected to a water bleed tube that would transport the bleed off water into the toilet bowl. These respective water inlet and water outlet valves would be electrically connected to a circuit board having a receiver and they would be actuated in response to a signal sent from the remote control transmitter when one of the respective buttons is pressed.

Two of the hinge disks are rigidly mounted on the transversely extending primary shaft. Movement of the first piston downwardly results in the toilet seat and seat cover being lifted together. The downward travel of the other piston would result in the rotation of the other two horizontal hinge disks and cause the seat cover to be lifted from a horizontal position to a vertical position.

DESCRIPTION OF THE PREFERRED EMBODIMENT

Figure 1:
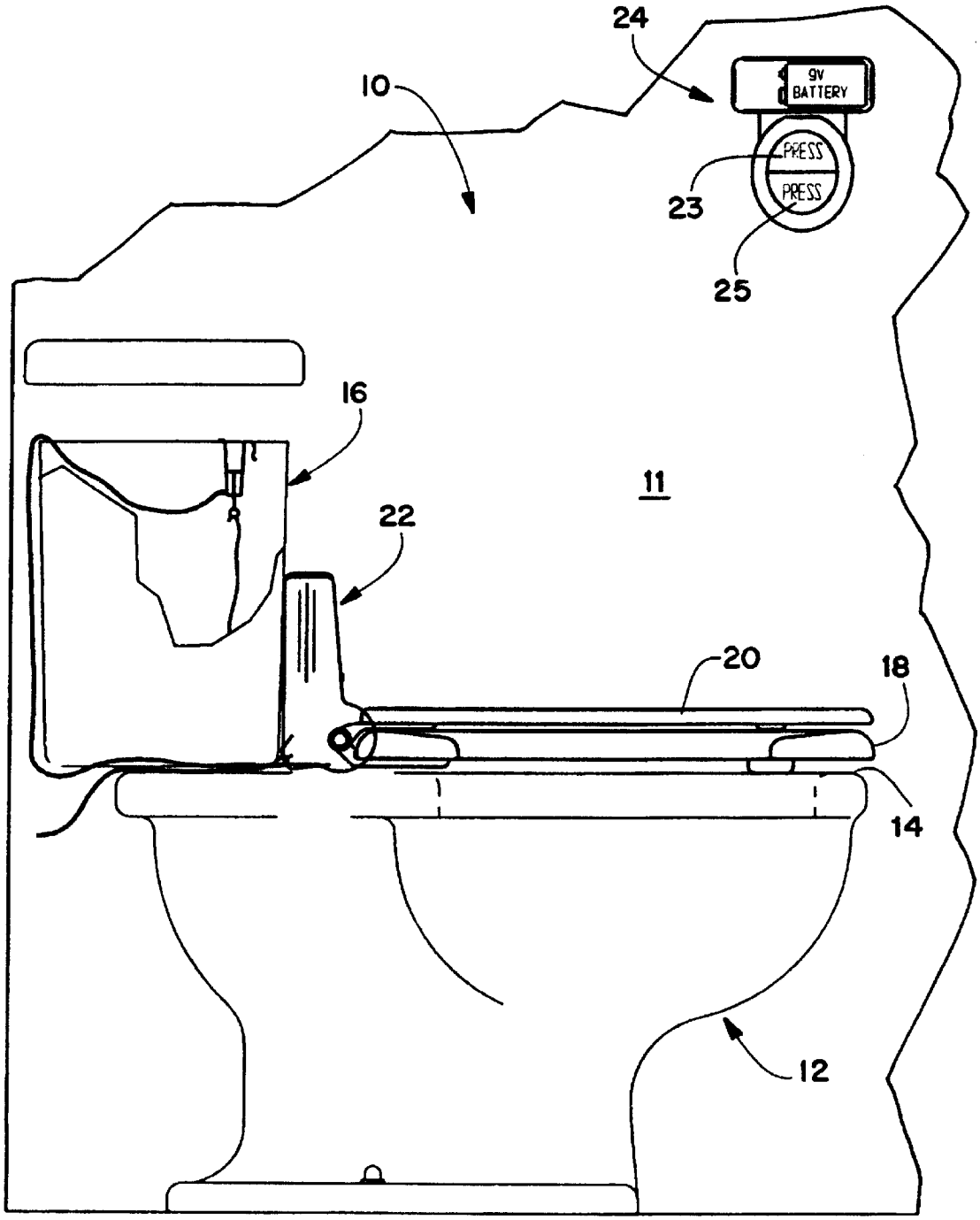
FIG. 1 is a schematic side elevation view of a toilet having the novel automated toilet seat and seat cover lifting and lowering system installed.
Figure 2:
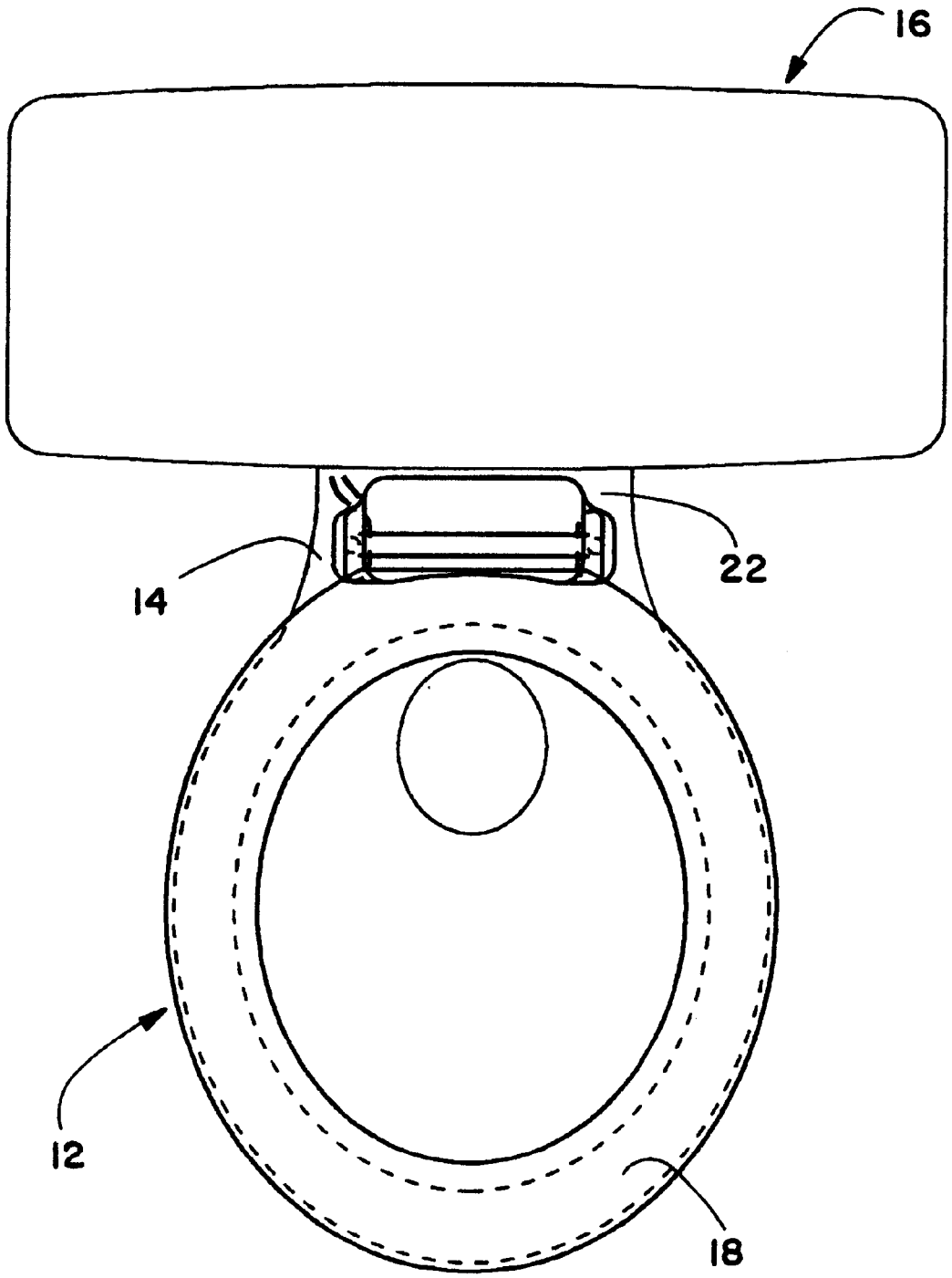
FIG. 2 is a schematic top plan view of the toilet with the automated toilet seat and seat cover lifting and lowering system installed.

The novel automated toilet seat and seat cover lifting and lowering system will now be described by referring to FIGS. 1–9 of the drawings. The system is generally designated numeral 10 and it has a toilet bowl 12, a water tank 16, a toilet seat 18 and a seat cover 20. A lever actuator housing 22 is mounted on the top surface 14 of toilet bowl 12. A remote control transmitter unit 24 would normally be mounted on the wall adjacent the toilet or on the wall near the bathroom door.

Figure 3A:
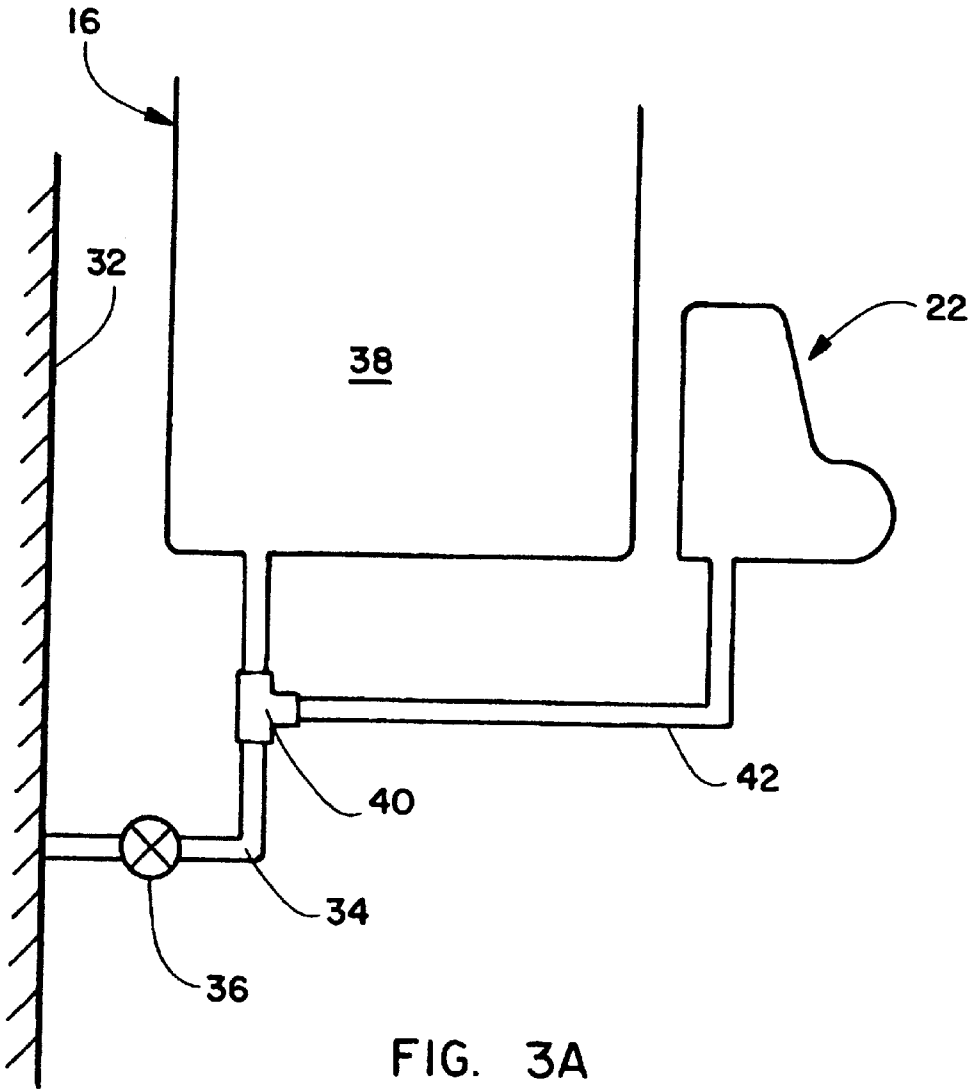
FIG. 3A is a schematic diagram of the pressurized water flow path of the automated toilet seat and seat cover lifting and lowering system.
Figure 3B:
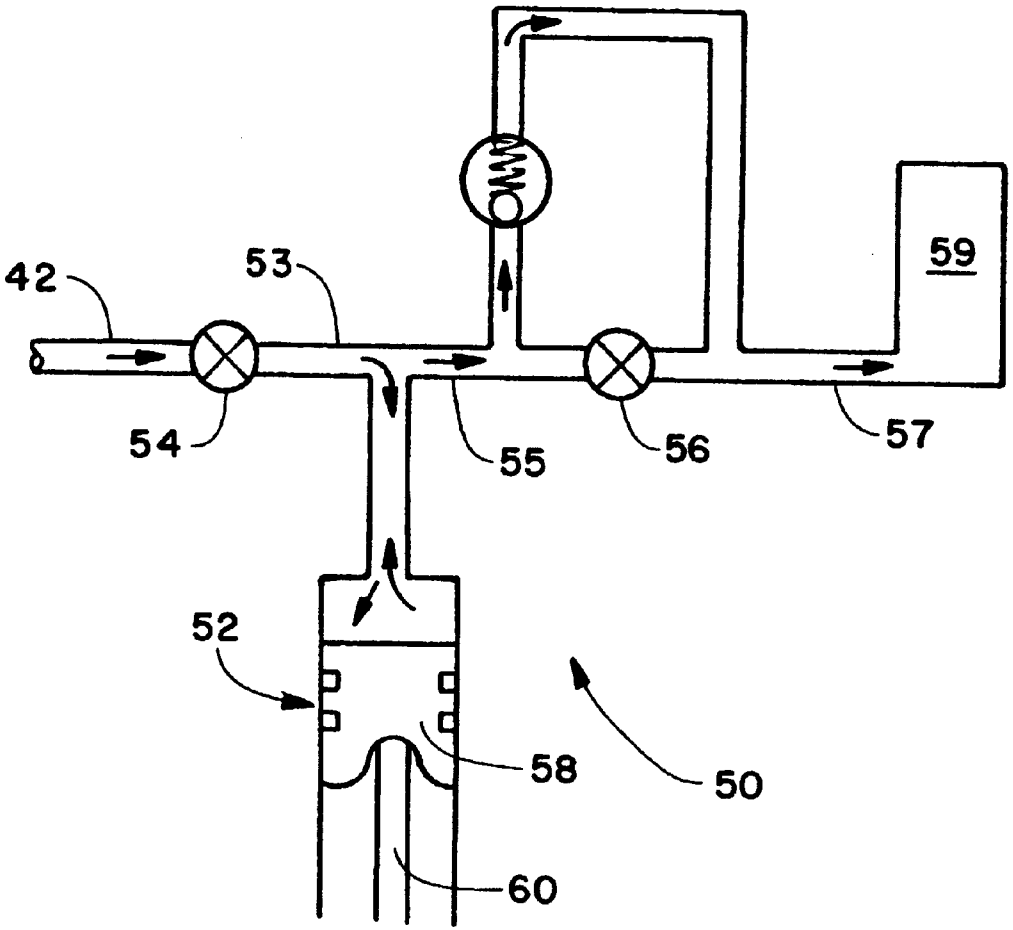
FIG. 3B is a schematic diagram of the specific pressurized water flow path inside the lever actuator housing.

FIG. 3A is a schematic diagram showing the novel system. A source of pressurized water, approximately 50 psi, is delivered from wall 32 into primary tubular member 34. A valve 36 is used to shut off the flow of water to the toilet. The front end of tubular member 34 is connected to the water chamber 38 in water tank 16. A T-connector 40 connects secondary tubular member 42 to specific structure of the actuator assembly 50 in lever actuator housing 22. Remote control transmitter unit 24 has an RF transmitter that is activated by buttons 23 and 25.

Figure 4:
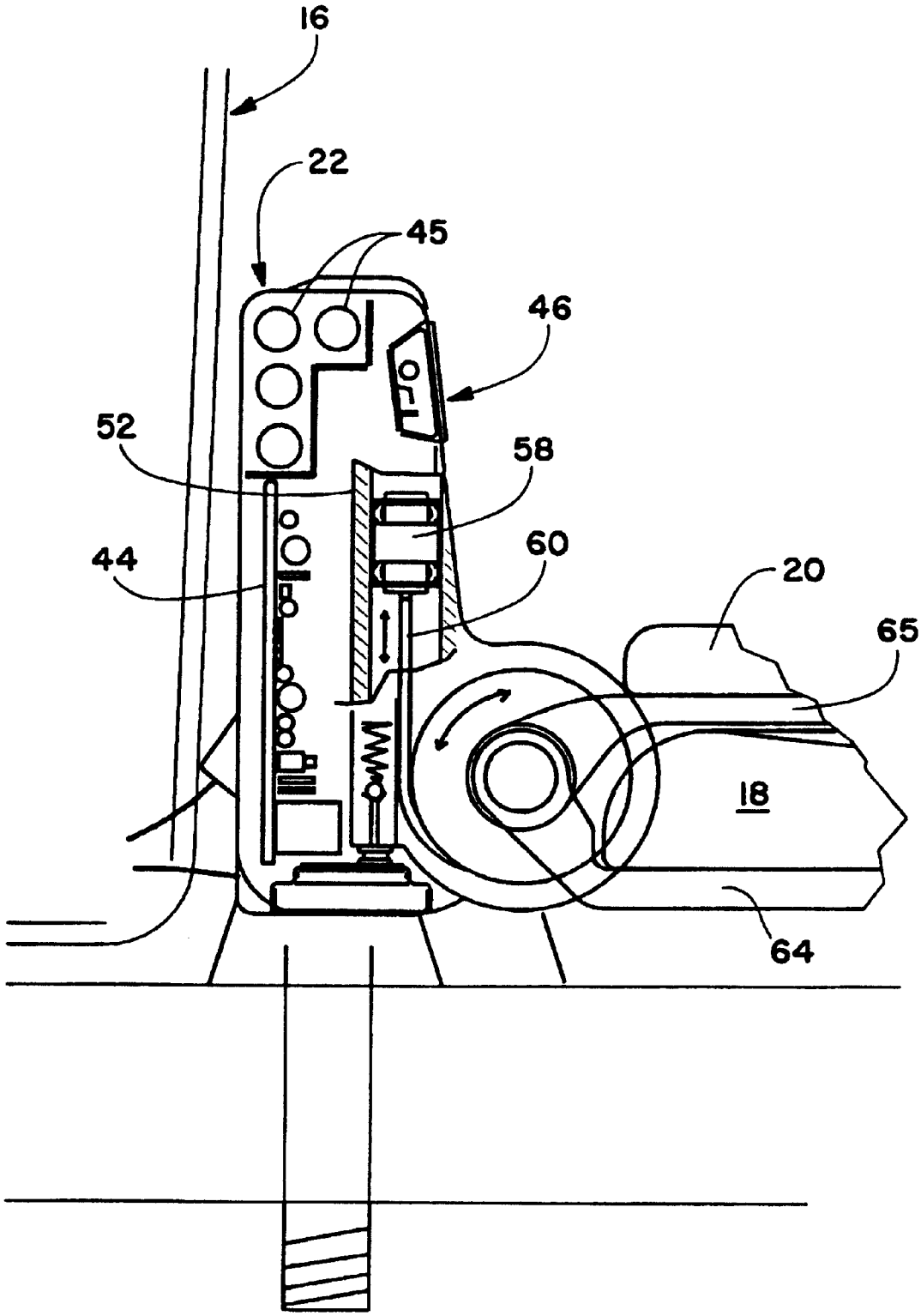
FIG. 4 is a schematic sidw elevation view with portions broken away illustrating the lever actuator housing and its internal components.
Figure 5:
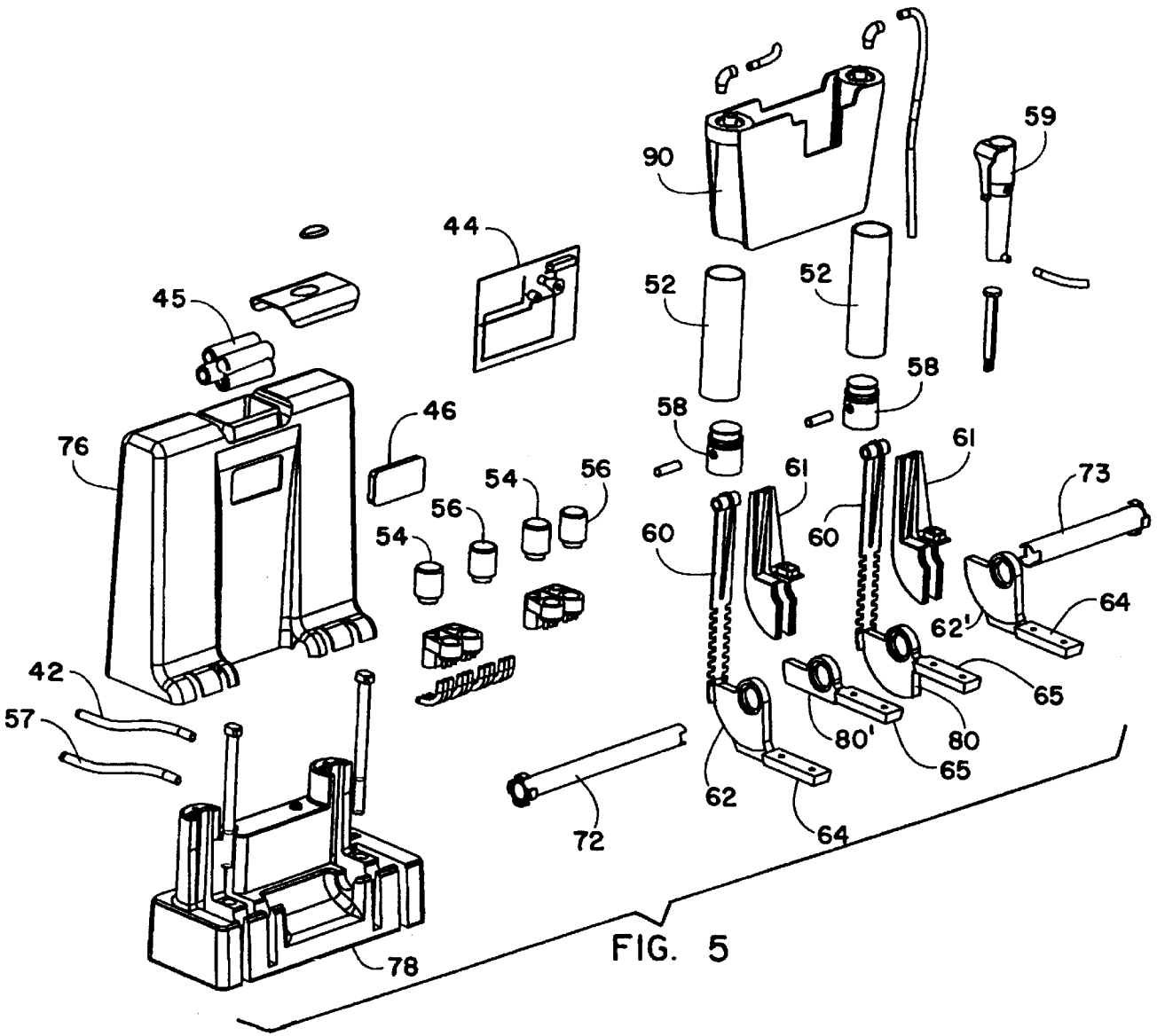
FIG. 5 is an exploded perspective view of the components found in the lever actuator assembly.

FIG. 4 is a schematic illustration of lever actuator housing 22 showing portions broken away for clarity. Mounted therein is a PC board 44 having an operation logic circuit thereon. The source of power for the electrical circuits are batteries 45. An infra-red sensor 46 is mounted on the front wall of lever actuator housing 22 and it would be connected to a valve for flushing the toilet once the user has moved away from the toilet.

Actuator assembly 50 is best understood by referring to FIGS. 3B and 5–7. It is mounted in lever actuator housing 22. There are two piston cylinders 52 and each has a water inlet solenoid valve 54 that is connected to secondary tubular member 42 to provide a source of pressurized water. Also each piston cylinder 52 has a water outlet solenoid valve 56 that would be connected to a tube 57 for bleeding off the pressurized water to flash actuator 59 once the toilet seat 18 and seat cover 20 has traveled to their horizontal position. A piston 58 is mounted in each of the piston cylinders 52 and the bottom end of each piston 58 is connected to the top end of a pressure band 60. The bottom ends of pressure bands 60 pass through a track in guides 61 as pistons travel downwardly and rotate the respective hinge disks 62 and 80. Lever actuator housing 22 has a cover 76 that attaches to the top of base assembly 78. A manifold head 90 is connected to the top ends of the respective piston cylinders 52.

Figure 6:
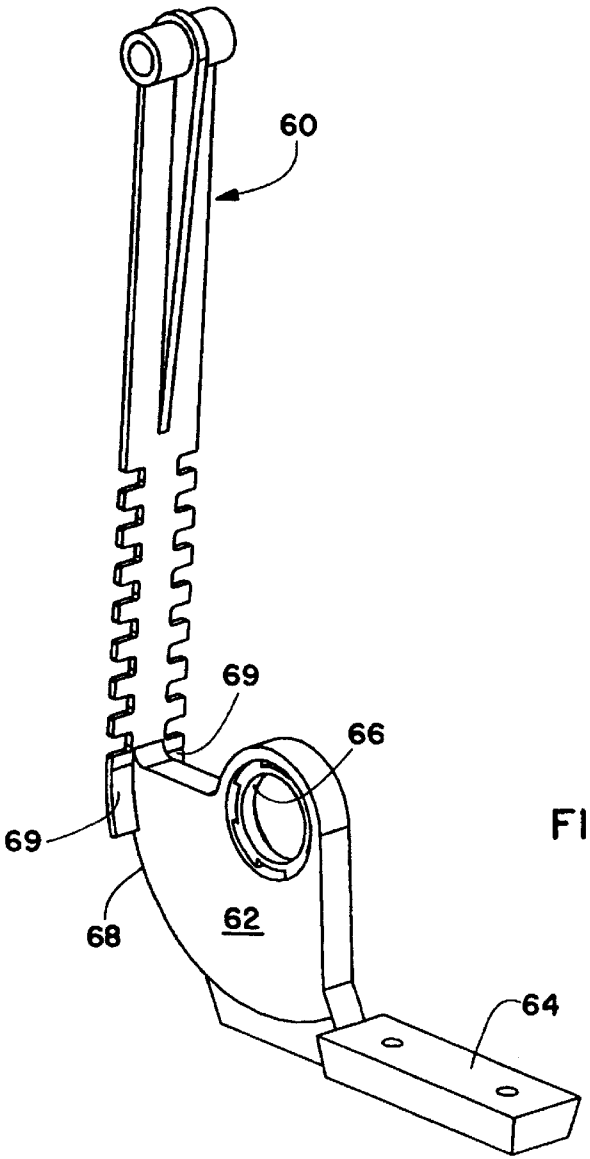
FIG. 6 is a CADCAM front perspective view illustrating a major component of the actuator assembly.
Figure 7:
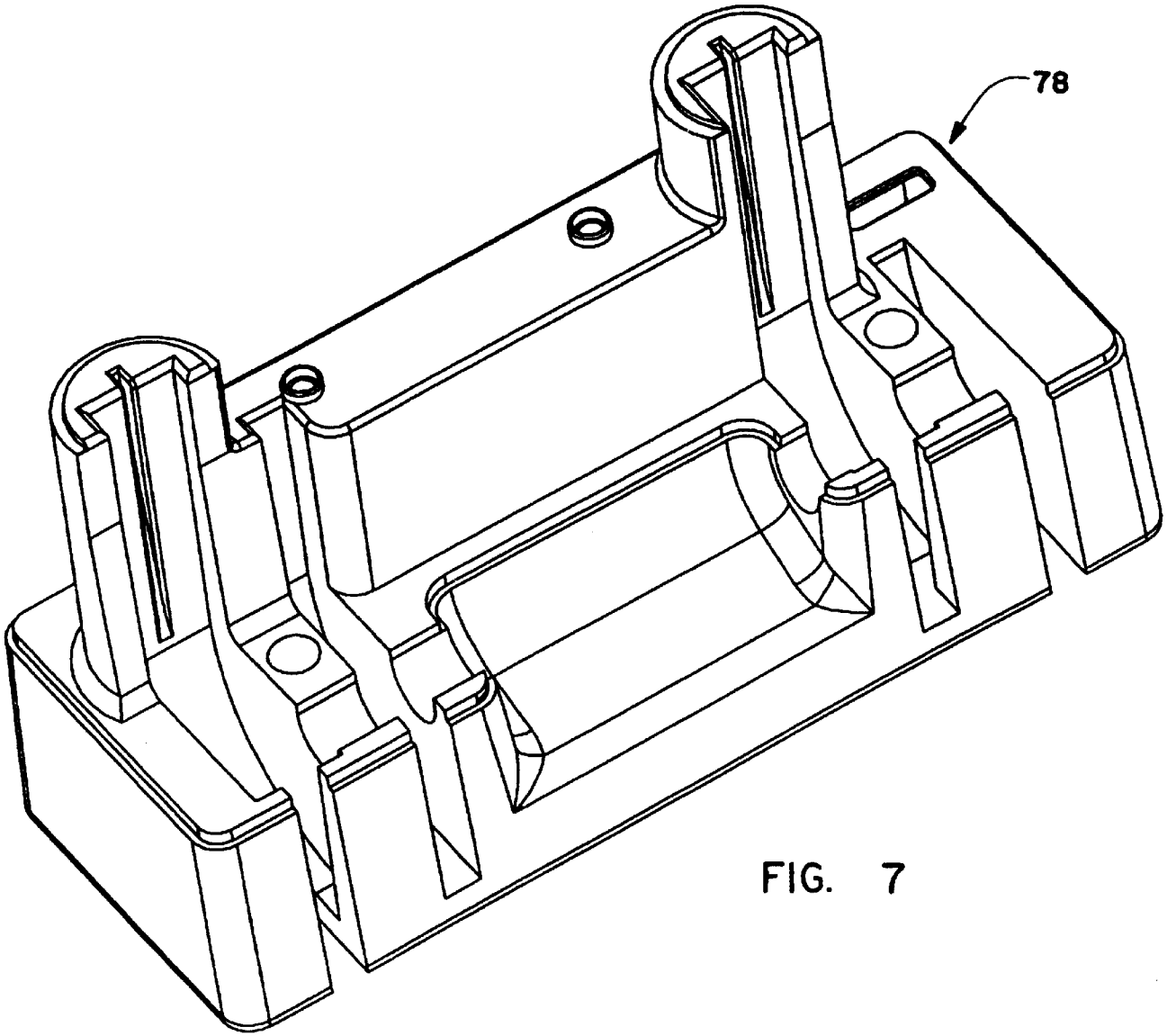
FIG. 7 is an enlarged front perspective view of the base assembly of the lever actuator assembly.
Figure 8:
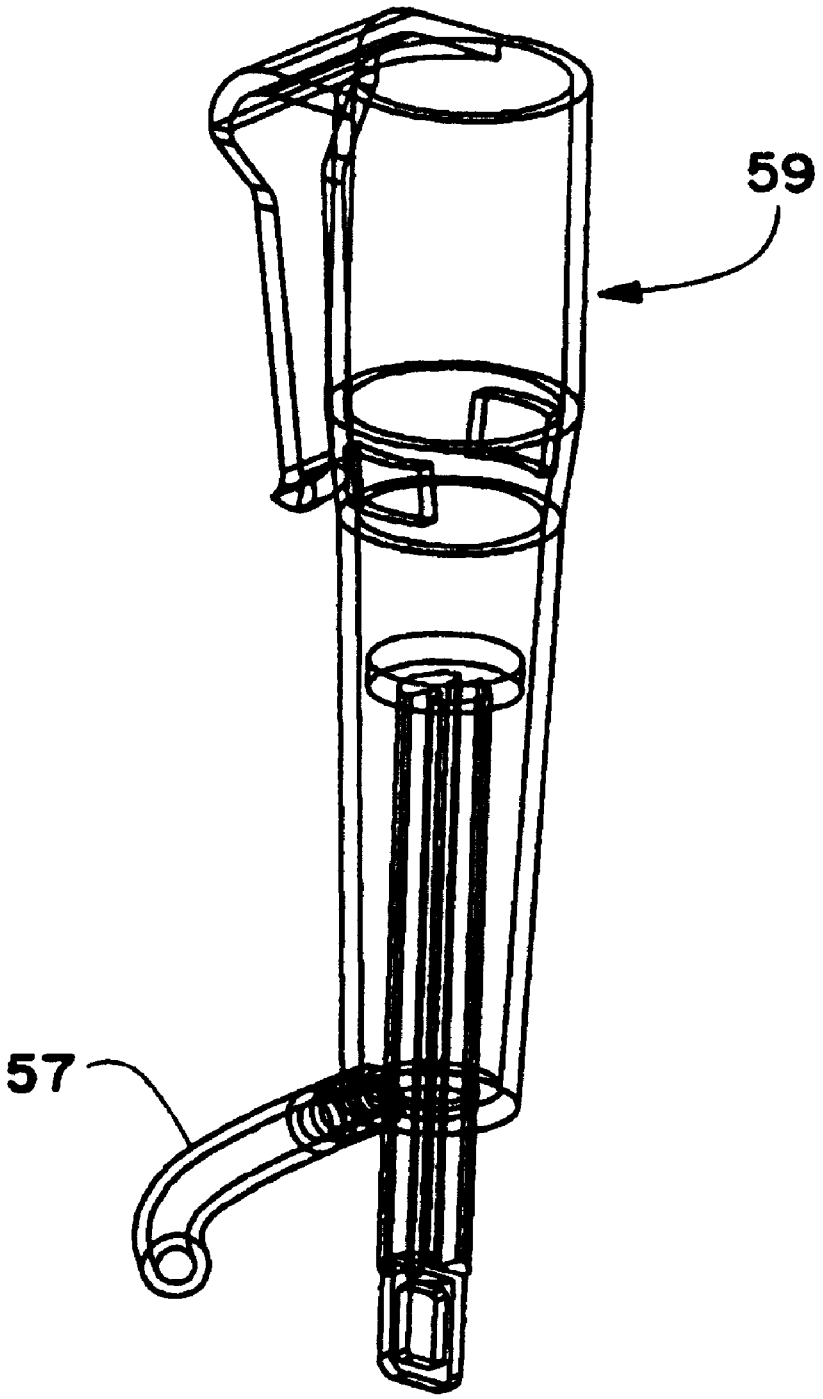
FIG. 8 is a CADCAM front perspective view of the flush activator.
Figure 9:
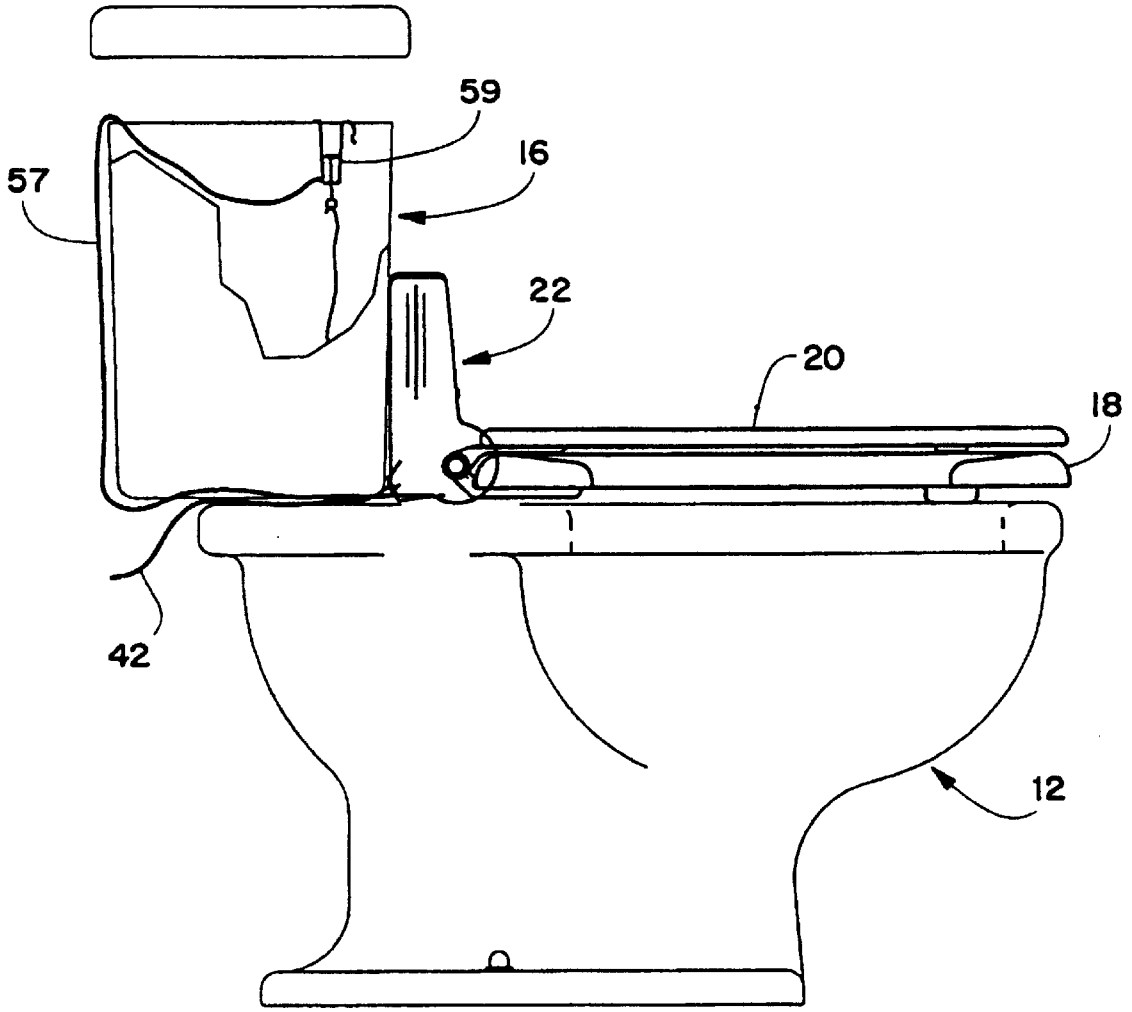
FIG. 9 is a schematic side elevation view showing the flush actuator mounted in the water tank.

FIG. 6 illustrates one of the pressure bands 60 and the manner in which it engages the left hinge disk 62. Right hinge disk 62' does not have a pressure band 60 but it is rigidly connected together with left hinge disk 62 by inner torque shaft 72 that has a splined outer surface that mates with the respective bore holes 66 of hinge disks 62 and 62'. A lifting lever 64 is connected to the front ends of hinge disk 62 and 62'. The bottom end of pressure band 60 has a cutout slot 68 that forms bifurcated fingers 68 and 69. This combination of structure engages the peripheral edge of hinge disk 62. Right hinge disk 80 has a pressure band 60 connected to it and is forced to pivot upon downward travel of its piston 58. Left hinge disk 80' does not have a pressure band 60 but it is rigidly connected together with right hinge disk 80 by an outer torque shaft 73 that mates with the respective bore holes 66 of hinge disks 80 and 80'. Torque shaft 72 telescopes into torque shaft 73 and is journaled therein. The lifting levers 64 and 65 are connected respectively to the rear end of the toilet seat 18 and seat cover 20. Therefore as the left piston 58 is forced downwardly, its travel of approximately 1¾ inches will cause the lifting levers 64 to pivot through approximately 90 degrees thereby lifting the toilet seat 18 and seat cover 20 from their horizontal position to a vertical position. When the right piston 58 is forced downwardly, its travel will cause the lifting levers 65 to pivot through approximately 90 degrees thereby only lifting seat cover 20 from its horizontal position to a vertical position.

What is claimed is:

1. An automated toilet seat and seat cover lifting and lowering system comprising:

a toilet bowl having a top surface;

a water tank connected to said toilet bowl; said water tank having an interior water chamber;

a pressurized water source;

a primary tubular member having a first end and a second end; said first end being connected to said pressurized water source; said second end being connected to said water chamber in said water tank;

a toilet seat resting on said top surface of said toilet bowl; said toilet seat having a front end and a rear end;

a lever actuator housing mounted on said top surface of said toilet bowl adjacent said rear end of said toilet seat; said lever actuator housing having a height less than the height of said toilet bowl; said lever actuator housing having a front end having at least one first lifting lever extending forwardly therefrom; said first lifting lever being connected to said rear end of said toilet seat; said rear end of said first lifting lever is connected to an upright oriented hinge disk having a horizontally oriented bore that receives a horizontally oriented shaft;

a secondary tubular member having a first end and a second end; said first end being connected to said primary tubular member and providing a passageway for some of said pressurized water; said second end being connected to actuator assembly means inside said lever actuator housing for using said pressurized water to raise said first lifting lever from a horizontal position to a vertical position; and said actuator assembly means comprises at least one piston cylinder having a water inlet port adjacent its top end, a water outlet port adjacent its top end, and a piston having a top end and a bottom end positioned in said piston cylinder; said second end of said secondary tubular member being connected to said water inlet port to provide pressurized water flow against said top end of said piston.

2. An automated toilet seat and seat cover lifting and lowering system comprising:

a toilet bowl having a top surface;

a water tank connected to said toilet bowl; said water tank having an interior water chamber;

a pressurized water source;

a primary tubular member having a first end and a second end; said first end being connected to said pressurized water source; said second end being connected to said water chamber in said water tank;

a toilet seat resting on said top surface of said toilet bowl; said toilet seat having a front end and a rear end;

a lever actuator housing mounted on said top surface of said toilet bowl adjacent said rear end of said toilet seat; said lever actuator housing having a front end having at least one first lifting lever extending forwardly therefrom; said first lifting lever being connected to said rear end of said toilet seat; said rear end of said first lifting lever is connected to an upright oriented hinge disk having a horizontally oriented bore that receives a horizontally oriented shaft;

a second tubular member having a first end and a second end; said first end being connected to said primary tubular member and providing a passageway for some of said pressurized water; said second end being connected to actuator assembly means inside said lever actuator housing for using said pressurized water to raise said first lifting lever from a horizontal position to a vertical position; and said actuator assembly means comprises at least one piston cylinder having a water inlet port adjacent its top end, a water outlet port adjacent its top end, and a piston having a top end and a bottom end positioned in said piston cylinder; said second end of said secondary tubular member being connected to said water inlet port to provide pressurized water flow against said top end of said piston; an elongated bendable force transmitting member having a top end and a bottom end; said top end being connected to said bottom end of said piston and said bottom end being connected to said hinge disk so that downward travel of said piston forces said hinge disk to rotate said horizontally oriented shaft and lift said first lifting lever and said toilet seat to a vertical position.

3. An automated toilet seat and seat cover lifting and lowering system as recited in claim 2 further comprising means for remotely releasing pressurized water to said water inlet port of said piston cylinder.

4. An automated toilet seat and seat cover lifting and lowering system as recited in claim 3 further comprising means for releasing water out through said water outlet port of said piston cylinder.

5. An automated toilet seat and seat cover lifting and lowering system as recited in claim 3 wherein said means for remotely releasing, pressurized water to said inlet port comprises a radio frequency receiver, a battery, and an electric circuit in said lever actuator housing on said piston cylinder.

6. An automated toilet seat and seat cover lifting and lowering system as recited in claim 2 further comprising an infra-red sensor mounted in said front end of said lever actuating housing for actuating a toilet flushing valve.

7. An automated toilet seat and seat cover lifting and lowering system as recited in claim 2 further comprising a seat cover and means in said lever actuator housing for lifting and lowering said seat cover.

* * * * *